US009778006B1

(12) United States Patent
Thomas et al.

(10) Patent No.: US 9,778,006 B1
(45) Date of Patent: Oct. 3, 2017

(54) EXPLOSIVE DEVICE AND MINI DEPTH CHARGE GRENADE

(71) Applicant: LOCKHEED MARTIN CORPORATION, Bethesda, MD (US)

(72) Inventors: Toby D. Thomas, Southlake, TX (US); Jonathan H. Record, Grand Prairie, TX (US); Kenneth W. Havens, Crowley, TX (US); David L. Hunn, Kennedale, TX (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 0 days.

(21) Appl. No.: 15/166,521

(22) Filed: May 27, 2016

Related U.S. Application Data

(62) Division of application No. 13/857,579, filed on Apr. 5, 2013, now Pat. No. 9,366,515.

(60) Provisional application No. 61/620,684, filed on Apr. 5, 2012.

(51) Int. Cl.

| | |
|---|---|
| ***F42B 21/00*** | (2006.01) |
| ***F42B 33/00*** | (2006.01) |
| ***F42C 9/10*** | (2006.01) |
| ***F42C 3/00*** | (2006.01) |

(52) U.S. Cl.
CPC ..... *F42B 21/00* (2013.01); *F42B 33/001* (2013.01); *F42C 3/00* (2013.01); *F42C 9/10* (2013.01)

(58) Field of Classification Search
CPC ..... F42B 21/00; F42B 12/00; F42B 12/02; F42B 12/20; F42B 12/201; F42B 12/36; F42B 27/00; F42B 30/04; F42B 30/08; F42C 3/00; F42C 5/00; F42C 9/08; F42C 9/10; F42C 14/04
USPC ..... 102/390, 391, 392, 408
See application file for complete search history.

(56) References Cited

U.S. PATENT DOCUMENTS

| | | | | |
|---|---|---|---|---|
| 1,314,413 | A | 8/1919 | Martena | |
| 2,945,440 | A * | 7/1960 | Vogt | F42C 5/00 102/265 |
| 3,199,454 | A | 8/1965 | Hart | |
| 3,537,397 | A | 11/1970 | Ripley et al. | |
| 4,188,884 | A | 2/1980 | White et al. | |
| 7,874,252 | B2 * | 1/2011 | Soto | F42B 21/00 102/406 |
| 8,387,535 | B1 | 3/2013 | Guirguis et al. | |

FOREIGN PATENT DOCUMENTS

| | | |
|---|---|---|
| GB | 191508589 | 2/1916 |

* cited by examiner

*Primary Examiner* — James S Bergin
(74) *Attorney, Agent, or Firm* — Terry M. Sanks, Esquire; Beusse Wolter Sanks & Maire, PLLC

(57) ABSTRACT

An explosive device contains a water-reactive material that ignites upon exposure to water. The water-reactive material ignites a water-activated fuse that has a predetermined burn rate and length. The predetermined burn rate and length allows the device to sink to a desired depth before exploding. Hence, the device explodes after a desired period of time and/or at a desired depth. Defense against underwater swimmers is an advantageous feature of embodiments of the disclosure. The device can use a forty millimeter (40 mm) form factor, which permits launch of the device from convention grenade launchers.

20 Claims, 2 Drawing Sheets

EXPLOSIVE DEVICE AND MINI DEPTH CHARGE GRENADE

CROSS-REFERENCE TO RELATED APPLICATIONS

This application is a Divisional of U.S. application Ser. No. 13/857,579 filed Apr. 5, 2013, which claims the benefit of U.S. Provisional Application No. 61/620,684 filed Apr. 5, 2012, the entire contents of which are hereby incorporated by reference herein.

TECHNICAL FIELD

The present disclosure relates generally to an explosive device and, in particular embodiments, to a launchable depth charge device for, e.g., counter against hostile underwater swimmers.

BACKGROUND

When hostile underwater swimmers are detected near a Navy vessel, several defense options may be considered. However, many of these defense options are ill-suited to provide a suitable defense of the vessel. For instance, small arms fire will not penetrate more than two to four feet of water with any lethal force. In addition, the vessel or ship may be in water of insufficient depth to use standard depth charges. Heavy platform mounted weapons may not be capable of being directed to suppressed elevations. Also, hand thrown grenades may not be capable of being thrown far enough or accurately enough to counter the attack. Standard forty millimeter (40 mm) grenades are fused for impact detonation and may not hit hard enough in water to detonate or, if they do, will explode at the surface of the water.

What is needed, then, is a device that overcomes the disadvantages of the prior art.

SUMMARY

This concept provides the vessel's defenders the option to fire an explosive device, e.g., a forty millimeter (40 mm) grenade, which is designed to detonate after sinking to a designated depth or after a set amount of time has elapsed through use of a water-activated fuse train. This would enable the defenders to lay an extended defense parameter around the vessel. The concussive effects of the grenade going off at depth would disorient, disable, or kill any hostile underwater swimmers without hazard to the vessel or its defenders.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered to be limiting of its scope, the embodiments will be described and explained with additional specificity and detail through the use of the accompanying drawings in which.

DETAILED DESCRIPTION

Figure 1:
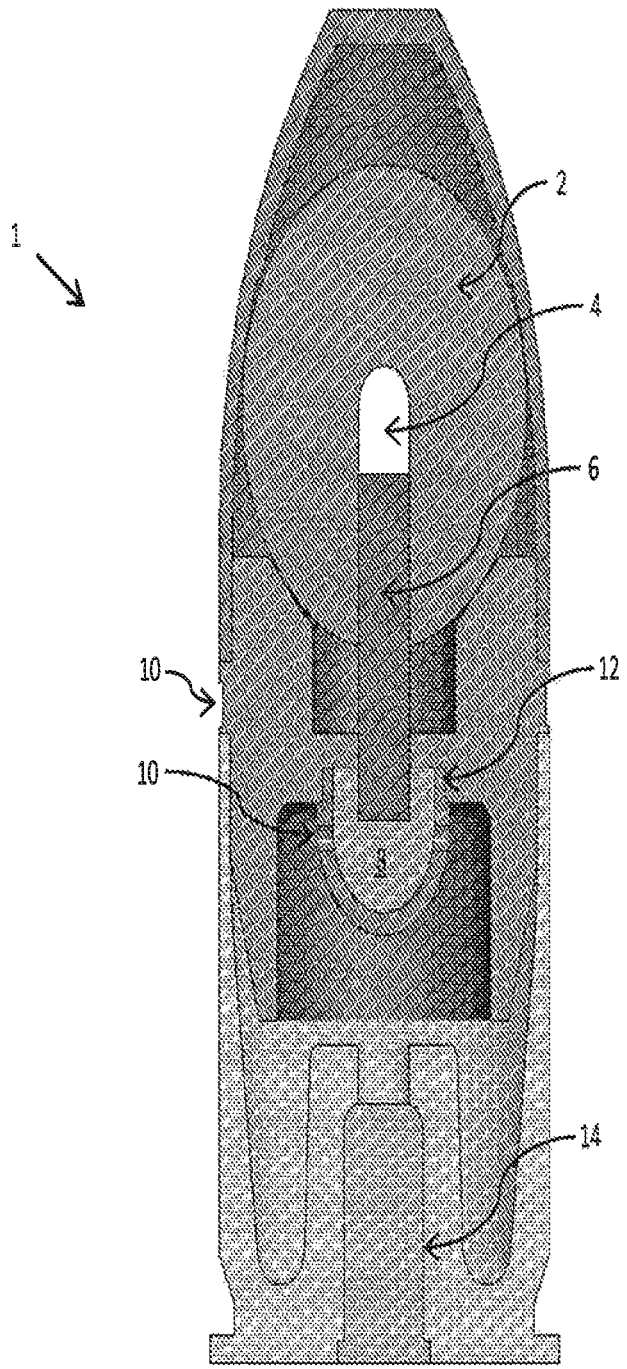
FIG. 1 is a cross-sectional view of an embodiment depth charge device.

Embodiments are described herein with reference to the attached figures wherein like reference numerals are used throughout the figures to designate similar or equivalent elements. The figures are not drawn to scale and they are provided merely to illustrate aspects disclosed herein. Several disclosed aspects are described below with reference to non-limiting example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. The embodiments are not limited by the illustrated ordering of acts or events, as some acts may occur in different orders and/or concurrently with other acts or events. Furthermore, not all illustrated acts or events are required to implement a methodology in accordance with the embodiments.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

In one illustrative embodiment, the depth charge device is realized as a 40 mm grenade fired from a M203 or M320 grenade launcher. Other grenade launchers, such as M79 launchers and MK19 and MK47 automatic grenade launchers could be employed as well, in other embodiments. The grenade has been designed to detonate after sinking to a designated depth or after a set amount of time has elapsed. This device will enable the defenders to lay an extended defense parameter around a vessel (a.k.a., ship, boat, water vehicle, etc.). The concussive effects of the grenade going off at depth would disorient, disable, or kill any hostile underwater swimmers without hazard to the vessel or its defenders.

An illustrative device 1 is illustrated in FIG. 1. In an illustrative embodiment, the explosive device is implemented in a forty millimeter (40 mm) grenade form factor. Such a form factor allows the device to be launched from a standard grenade launcher without modification or without substantial modification. In one embodiment, device 1 includes a payload of high explosives 2 such as Trinitrotoluene (or more specifically, 2,4,6-trinitrotoluene, which is commonly known as TNT), Composition B explosive, Pentaerythritol tetranitrate (PETN), HMX (a.k.a., octogen), nitrocellulose, and the like.

Device 1 includes one or more vents or openings 10 in the outer casing (a.k.a., shell, jacket, etc.). These openings 10 (sometimes referred to as ports) allow water to enter the interior of the device 1. Upon being launched and landing in water, water passes through opening 10 into a fuse ignition chamber 12. The water reacts energetically with a water-reactive material, such as sodium 8. In an embodiment, the fuse ignition chamber 12 functions as a sodium retaining plug configured to retain the sodium 8 in place.

The reaction of sodium 8 with water ignites fuse train 6. Fuse train 6 (sometimes referred to a fuse train stick) can be designed for a specific burn time. The burn rate of the fuse train 6 allows device 1 to sink a predetermined depth before exploding. When fuse train 6 burns down to detonating charge 4, the detonating charge 4 detonates. Detonation of the detonating charge 4 detonates the high explosive 2. If the water is shallower than the estimated sink distance the device will land on the bottom and will still explode without regard to the depth.

In some embodiments, device 1 has an outer casing or shell that is not water tight, in which case water can flow freely into the casing. In those embodiments, openings 10 in the outer casing are not necessary, but rather, openings 10 may be formed in the chamber 12 in which water-reactive material is contained. In some embodiments, both the outer casing and the chamber 12 holding the water-reactive material have openings for allowing ingress of water. These openings might be the same (i.e., one continuous opening that extends through the outer casing and through the wall of the chamber), or might be discontinuous (i.e., not aligned to one another).

Device 1 also includes primer and propelling charge 14 which are used to launch the device from a launcher. Primer and propelling charge 14 allow device 1 to be fired, e.g., from a M203 or M320 grenade launcher. In other embodiments, device 1 can be fired from a crew served M19 automatic grenade launcher.

An advantageous feature of the illustrative embodiment is that it provides for defense of military or commercial ships and water vehicles, particularly against underwater swimmers. In particular, the blast wave from device 1 in exploding passes through the human body (of a hostile swimmer or combatant) as the human body is of similar consistency to water. Hence, molecules of the human body are displaced very little except in gas spaces capable of compression. Damage is at the gas water interfaces within the body. The gas in the gas filled cavities is instantaneously compressed as the pressure wave passes through the body and the walls of the spaces are torn or shredded as in barotrauma. Damage occurs in the lungs, intestines, sinuses and ear cavities. In the lungs, the damage is not necessarily due to pressure transmitted via the upper airways (as in air blasts), but as a result of transmission of the wave directly through the thoracic wall.

Experiments have demonstrated the efficacy of underwater explosive devices, such as the illustrative embodiments described herein, in disabling or killing enemy combatants. Damage to the respiratory system includes pulmonary hemorrhages at bases, bronchi and trachea, as well as alveolar and interstitial emphysema, and pneumo-haemothorax damage. Intestinal damage includes subserous and submucosal hemorrhage and perforations. Presumably because of the lack of gas cavities, damage to the kidney, bladder, liver and gallbladder is de minimus or non-existent. Studies suggest that if both the thorax and abdomen were immersed in the water in which the explosion occurs, the lungs would be more affected. If only the abdomen were immersed the intestines were most affected, with injury as described above and including rectal bleeding.

Primary causes of death resulting from an underwater explosion of device 1 would include: (1) pulmonary damage (e.g., low arterial O.sub.2 saturation (PaO.sub.2) hypoxaemia, high arterial CO.sub.2 retention (PaCO.sub.2) hypercarbia, and respiratory acidosis); (2) brain damage (e.g., petechial hemorrhage and oedema caused by a rapid increase in the venous pressure, following compression of the thoracic and abdominal venous reservoirs by the pressure wave, which causes small blood vessels rupture in the cerebral venous system); and (3) air embolism (e.g., due to the rupture of lung alveoli and the compression of the alveolar gas which enters the pulmonary vein, left ventricle, and cerebro-vascular system causing an air embolism to the brain). Secondary causes of death could include: pulmonary broncho-pneumonia; brain coma; intestinal perforation and peritonitis; as well as other secondary effects of concussion and shock.

For a device 1 that is hand propelled, the provision of primer and propelling charge 14 can be omitted. Likewise, other form factors than the above-described 40 mm grenade are within the contemplated scope of the disclosure.

In some embodiments, a covering (not shown) could be used to cover or protect openings 10 and to prevent accidental discharge of device 10 in the event of exposure to moisture during storage and/or handling. This covering could be removed prior to launching the device or could be designed to peel off or otherwise eject from the device during launch or during flight (e.g., due to the shock of the launch, due to rapid changes in air pressure during launch, due to air friction during flight, and the like). In some embodiments, the covering could be water soluble such that the covering rapidly dissolves upon immersion in water. In still other embodiments, the covering could take the form of water-soluble plugs (not shown) that fill openings 10, but that rapidly dissolves upon contact with water. In some embodiments, such plugs might not be water soluble, but might be designed to evacuate openings 10 upon launch and/or flight.

While sodium has been described as the water-reactive material in an embodiment, those skilled in the art will recognize that other materials, e.g., strontium metal, lithium metal, phosphorous pentachloride, potassium hydroxide, and the like could be used. As a guide, the material should react with water in a controllable manner (i.e., sufficiently violently to ignite fuse train 6, but not so violently as to detonate charge 4). Such a material is generally described herein as a water-reactive material.

Figure 2:
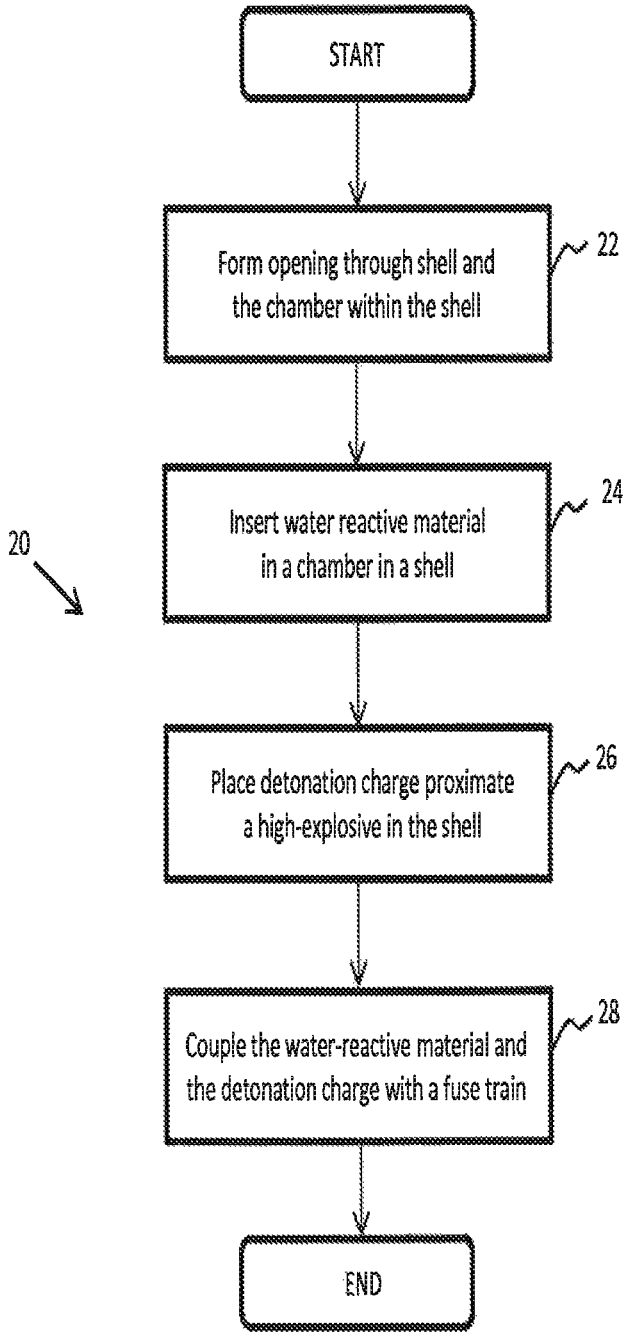
FIG. 2 is a method of constructing an explosive device.

Referring now to FIG. 2, a method 20 of constructing an explosive device is illustrated. In block 22, an opening 10 is formed through a shell and the chamber 12 within the shell 1. As noted above, if the shell has a water soluble casing or otherwise permits water to ingress into the shell, the opening 10 or port may only be needed in the chamber 12 holding and/or supporting the water-reactive material. In block 24, the water-reactive material 8 (e.g., sodium) is inserted within the chamber 12 of the shell 1. In block 26, the detonation charge 4 is placed proximate the high-explosive 2 in the shell 1. Thereafter, in block 28, the water-reactive material 8 and the detonation charge are coupled with the fuse train 6. In an embodiment, the order of the steps in the method 20 may be rearranged, swapped, and so on.

While this disclosure has been made with reference to illustrative embodiments, this description is not intended to be construed in a limiting sense. Various modifications and combinations of the illustrative embodiments, as well as other embodiments of the disclosure, will be apparent to persons skilled in the art upon reference to the description. It is therefore intended that the appended claims encompass any such modifications or embodiments.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising." Moreover, unless specifically stated, any use of the terms first, second, etc., does not denote any order or importance, but rather the terms first, second, etc., are used to distinguish one element from another.

Unless otherwise defined, all terms (including technical and scientific terms) used herein have the same meaning as commonly understood by one of ordinary skill in the art to which embodiments of the invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

While various disclosed embodiments have been described above, it should be understood that they have been presented by way of example only, and not limitation. Numerous changes, omissions and/or additions to the subject matter disclosed herein can be made in accordance with the embodiments disclosed herein without departing from the spirit or scope of the embodiments. Also, equivalents may be substituted for elements thereof without departing from the spirit and scope of the embodiments. In addition, while a particular feature may have been disclosed with respect to only one of several implementations, such feature may be combined with one or more other features of the other implementations as may be desired and advantageous for any given or particular application. Furthermore, many modifications may be made to adapt a particular situation or material to the teachings of the embodiments without departing from the scope thereof.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present disclosure in any way.

Therefore, the breadth and scope of the subject matter provided herein should not be limited by any of the above explicitly described embodiments. Rather, the scope of the embodiments should be defined in accordance with the following claims and their equivalents.

We claim:

1. A method, comprising:

forming, in a shell of an explosive device having a chamber, an opening extending from the chamber through the shell, the shell housing a high explosive;

inserting a water-reactive material within the chamber of the shell;

providing a water-activated fuse train having a burn rate which is a function of a sink rate of the explosive device and an intended depth of detonation, the water-activated fuse train having a first end and a second end, the first end and the second end being separated by a length of the water-activated fuse train;

placing a detonation charge within the shell in proximity to the high explosive and coupling the charge to the second end of the water-activated fuse train; and coupling the water-reactive material with the water-activated fuse train, the water-reactive material to ignite the water-activated fuse train when exposed to water and the water-activated fuse train to burn down to the detonation charge which is separate from the chamber.

2. The method of claim 1, wherein the water-reactive material is one of sodium, strontium metal, lithium metal, phosphorous pentachloride, and potassium hydroxide.

3. The method of claim 1, wherein the detonation charge is configured to detonate the high explosive within the shell.

4. The method of claim 1, wherein the water-activated fuse train is disposed between the water-reactive material and the high explosive.

5. The method of claim 4, wherein the length corresponds to the intended depth of detonation at which the high explosive will detonate when the water-activated fuse train burns down to the detonation charge.

6. The method of claim 1, wherein the high explosive is one of Trinitrotoluene (TNT), Composition B, Pentaerythritol tetranitrate (PETN), octogen (HMX), and nitrocellulose.

7. The method of claim 1, wherein the shell has a forty millimeter (40 mm) grenade form factor.

8. The method of claim 1, wherein the forming of the opening includes forming a continuous opening extending from within the chamber to outside of the shell.

9. The method of claim 1, further comprising inserting a primer and a propelling charge in an end of the shell.

10. The method of claim 1, further comprising protecting the shell with a covering, the covering being at least one of removable and water soluble.

11. The method of claim 1, wherein the explosive device to produce concussive effects at the intended depth which would cause injury to a hostile underwater swimmer near a vessel without hazard to the vessel.

12. A method, comprising:

forming an opening through a shell of an explosive device and a chamber within the shell;

inserting a water-reactive material within the chamber of the shell;

placing a detonation charge proximate a high-explosive in the shell, the detonation charge being separate from the chamber, and coupling the water-reactive material and the detonation charge with a water-activated fuse train, the water-activated fuse train having a burn rate which is a function of a sink rate of the explosive device and an intended depth of detonation of the detonation charge explosive to produce concussive effects by an explosion of the explosive device at the intended depth to cause injury to a hostile underwater swimmer near a vessel without hazard to the vessel.

13. The method of claim 12, further comprising inserting a primer and a propelling charge in an end of the shell.

14. The method of claim 12, further comprising protecting the shell with a covering, the covering being at least one of removable and water soluble.

15. The method of claim 12, wherein the high explosive is one of Trinitrotoluene (TNT), Composition B, Pentaerythritol tetranitrate (PETN), octogen (HMX), and nitrocellulose.

16. The method of claim 12, wherein the water-reactive material is one of sodium, strontium metal, lithium metal, phosphorous pentachloride, and potassium hydroxide.

17. The method of claim 12, wherein the shell has a forty millimeter (40 mm) grenade form factor.

18. The method of claim 12, wherein the water-activated fuse train having a first end and a second end, the first end and the second end being separated by a length of the water-activated fuse train, the length corresponds to the intended depth of detonation at which the high explosive will detonate when the water-activated fuse train burns down to the detonation charge.

19. The method of claim 18, wherein the water-activated fuse train is disposed between the water-reactive material and the high explosive.

20. A method, comprising:

forming, in an outer casing of an explosive device having a fuse ignition chamber, a port to allow ingress of water from outside of the outer casing to within the fuse ignition chamber, the explosive device configured to be launched from a small arms launch device;

placing a detonation charge proximate a high-explosive in the outer casing;

providing a water-activated fuse train having a first end and a second end being separated by a length of the water-activated fuse train to ignite the detonator charge, the water-activated fuse train having a burn rate which is a function of a sink rate of the device and an intended depth of detonation of the detonator charge which is separate from the fuse ignition chamber;

inserting a water-reactive material within the fuse ignition chamber; and connecting the water-reactive material to the first end of the water-activated fuse train, the water-reactive material to ignite the water-activated fuse train when exposed to water wherein the water-activated fuse train to burn down to the detonator charge.

* * * * *